United States Patent [19]

Seiford

[11] 4,085,693

[45] Apr. 25, 1978

[54] MECHANICAL LOCKING DEVICE FOR A LONGITUDINALLY SPLIT BOTTOM DUMP BARGE

[76] Inventor: Robert R. Seiford, c/o Twin City Shipyard, Inc. P.O. Box 3032, St. Paul, Minn. 55165

[21] Appl. No.: 754,213

[22] Filed: Dec. 27, 1976

[51] Int. Cl.[2] ..... B63B 35/30

[52] U.S. Cl. ..... 114/29; 114/77 R

[58] Field of Search ..... 114/26–30, 114/77 R, 249; 9/25

[56] References Cited

U.S. PATENT DOCUMENTS

| | | | |
|---|---|---|---|
| 3,186,369 | 6/1965 | McLennan et al. | 114/29 X |
| 3,509,841 | 5/1970 | De Boer | 114/29 |

FOREIGN PATENT DOCUMENTS

| | | | |
|---|---|---|---|
| 1,423,867 | 12/1966 | France | 114/249 |

*Primary Examiner*—Trygve M. Blix
*Assistant Examiner*—Sherman D. Basinger
*Attorney, Agent, or Firm*—Edwin E. Greigg

[57] ABSTRACT

In a longitudinally split bottom dump barge which is opened and closed by rotation of the two longitudinal halves of the barge relative to each other about a longitudinal axis on the top side of the barge by hydraulic pistons, mechanical device for locking the two halves of the barge together in their closed position includes a hook member, rotatably mounted on a shaft at the bottom inner side of one first barge half. When the hook is in its lowered locking position, it hooks about and rests upon a locking pin mounted at the bottom inner side of the other second barge half. An operating shaft linkage has one end pivotably attached to the hook and a threaded opposite end which engages with a hand wheel located on the top deck of the first barge half. The hand wheel is manually turned in one direction to raise the end of the hook member engaging the lock pin, to thus allow the split bottom of the barge to be opened. When the split bottom is again closed, the hand wheel is turned in the opposite direction to lower the end of the hook to engage the lock pin on the second barge half, and thus lock together the bottoms of the two barge halves.

7 Claims, 2 Drawing Figures

MECHANICAL LOCKING DEVICE FOR A LONGITUDINALLY SPLIT BOTTOM DUMP BARGE

BACKGROUND OF THE INVENTION

1. Field of the Invention

The invention relates generally to latching means for connecting together floatable assemblies, and in particular, to a device for locking together the two halves of a split dump barge when the hopper formed by the two halves is closed.

2. Prior Art

In a known type of longitudinally split bottom dump barge, the two halves of the barge are hinged together at their top side so that one half can be pivotally moved relative to the other half about a central longitudinal axis extending along the top of the barge. Generally this pivotal axis is defined by two in-line shafts at the front and back sides of the barge, to which both halves are journaled for pivotal movement thereabout which allows free access to the open cargo storage hopper therebetween. Two hydraulic rams, one at the front end of the barge and the other at the back, are each connected between the two halves of the barge to pull the respective bottoms and sides of the two halves together and thus close the cargo hopper for loading material therein, or to push apart the respective bottoms and sides of the two halves and thus open the cargo hopper for discharging material carried therein. Each half of the barge has adequate flotation chambers for supporting the barge when the cargo hopper is open. In the past, only these hydraulic rams, or similar opening and closing devices, have been employed to maintain the cargo hopper closed during transport of the material carried therein.

OBJECTS AND SUMMARY OF THE INVENTION

Therefore, a primary object of this invention is to provide a mechanical locking device which will prevent the opening of the cargo hopper of a longitudinally split bottom dump barge in the event of a sudden failure of the normal closing and holding means, and thus prevent the loss of the material carried by the barge and/or the pollution of the waterway at the point where such a failure occurs.

It is another object of the invention to provide a locking device as described above which includes safety interlocks to prevent actuation of the normal hopper opening means when the barge hopper is locked closed by this locking device.

It is another object of the invention that mechanical locking can be accomplished by one man, at main deck level, without any special equipment or tools.

Still another object of the invention is to provice a locking device as described herein which includes safety interlocks to prevent actuation of the normal hopper closing means when the locking device is in its locking position.

It is a further object of the invention to provide a locking device of the type described wherein the barge hopper can be closed by its normal closing means while the locking device is set in its locking position, with the locking device automatically locking the hopper closed upon complete closure, and providing visual indication of such locking at the top deck of the barge.

A still further object of the invention is to provide a locking device which can be manually operated by a single person at a single location.

Yet another object of the invention is to provide a locking device which can be easily installed in existing hydraulic ram compartments of split bottom dump barges.

A hooked-shaped locking plate, which is pivotably connected at one end to a bottom portion of one half of a longitudinally split bottom dump barge, hooks over a pin mounted on an adjacent opposite portion of the bottom of the other half of the dump barge to securely lock the two halves together. The locking plate is connected by an operating shift linkage to a manually operated wheel assembly on the top deck of the barge. The threaded upper end of the shaft linkage is in threaded contact with the internal threads of the hub of a hand wheel, so that the upper end of the shaft linkage can be raised or lowered by turning the hand wheel in one direction or in the opposite direction, which causes the lower end of the shaft linkage connected to the locking plate to rotate this plate between a raised unlocked position and a lowered locking position. The locking plate is so shaped that if closing of the barge hopper is initiated when the locking plate is set in its locking position, it will ride up and over the lock pin on the other half of the barge as the two halves approach one another, and will drop by its own weight into its locking position upon complete closure to securely lock the two halves together. When the locking plate rides up on the lock pin, the hand wheel at the top deck will also rise, then reseat itself in its normal position when the locking plate drops to its locking position, thus giving a visual indication of locking at the top deck. An electrical or mechanical interlock can be actuated by one of the moving elements of the shaft linkage to provide indication of the position of the locking plate and prevent actuation of the hopper opening means when the two halves of the barge are locked together by the locking plate.

The invention will be better understood as well as other objects and advantages thereof become more apparent from the following detailed description of the invention taken in conjunction with the drawing.

DESCRIPTION OF THE PREFERRED EMBODIMENT

Figure 1:
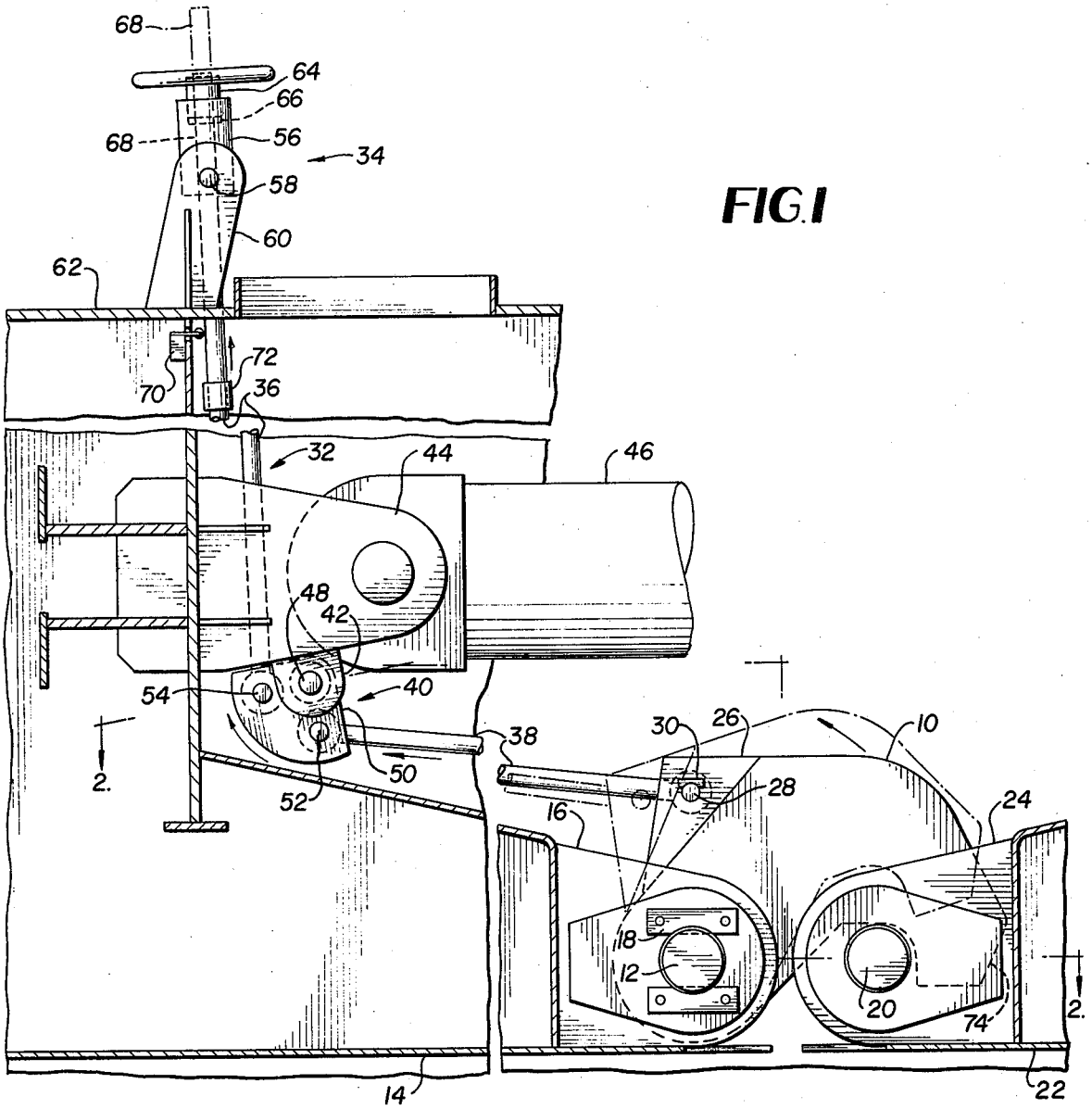
FIG. 1 is an elevation view of a preferred embodiment of this invention.
Figure 2:
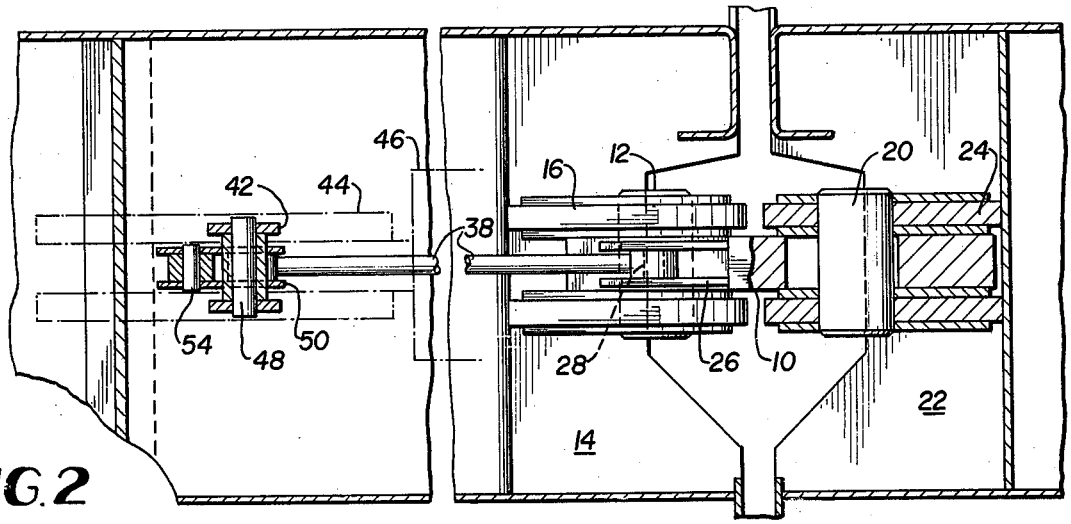
FIG. 2 is a cross-sectional top view of the embodiment shown in FIG. 1, taken along the line 2—2 of FIG. 1.

As shown in FIGS. 1 and 2, this locking device is located in one of the hydraulic ram compartments of a longitudinally split bottom dump barge as a matter of convention, since this space is available and designed for easy access to inspect and maintain the hydraulic equipment.

The locking plate member 10 is rotatably mounted on a longitudinally extending stainless steel journal pin 12, which is fastened to the bottom structure of a first half 14 of the dump barge by the support brackets 16 welded thereon. The pin 12 is held in place and prevented from rotating within its supports 16 by two locking straps 18, which rest in grooves cut into the pin 12 and are bolted to the supports 16. When the barge cargo hopper is closed and the locking plate member 10 is in its locking position, it hooks around and rests upon a longitudinally extending stainless steel locking pin 20, which is fastened to the bottom structure of the other half 22 of the dump barge by the support brackets 24 welded thereon opposite the journal pin 12. On the top side of the locking plate member 10, two projecting portions 26 carry a longitudinally extending connecting pin 28, which is held in place and prevented from rotating with its supports 26 by a locking strap 30, which rests in a transverse groove of the pin 28 and is bolted to one of the supports 26.

The locking plate member 10 is connected by an operating shaft assembly 32 to an operating wheel assembly 34 located on the top deck of the dump barge, with all three elements 10, 32 and 34 being disposed in approximately the same transverse plane of the barge. In the preferred embodiment of FIGS. 1 and 2, the operating shaft assembly 32 includes an upper shaft member 36 connected at one end to the operating wheel assembly 34, a lower shaft member 38 connected at one end to the locking plate member 10, and a connecting lever assembly 40 which links the other two ends of the upper and lower shaft members 36 and 38.

The connecting lever assembly 40 includes two support brackets 42, welded to the support brackets 44 for the hydraulic ram 46, which carry a longitudinally extending pin 48. Two spaced-apart plates 50, which are journaled for pivotal movement about the pin 48, carry two additional longitudinally extending pins 52 and 54. The lower shaft member 38 is journaled at one end to the pin 28 carried by the locking plate member 10, and at an opposite end to the pin 52 carried by the connecting lever assembly 40. Similarly, the lower end of the upper shaft member 36 is journaled to the pin 54 for pivotal movement thereabout.

The operating wheel assembly 34 includes a housing 56 which is pivotably mounted by shaft extensions 58 to support members 60 welded to the top deck 62 of the barge to be pivotable about a longitudinal axis. The internally threaded hub of a hand wheel 64 slides into a recessed space at the top of the housing 56, and rests against a thrust bearing 66. The upper end of the upper shaft member 36 is connected to an externally threaded shaft extension 68, which extends through the housing 56 and engages in threaded contact with the hand wheel 64.

When the hand wheel 64 is turned in a direction to raise the shaft extension 68 and upper shaft member 36, the connecting lever 40 rotates to move the lower shaft member 38 in a direction away from the longitudinal axis of the barge, which causes the locking plate member 10 to rotate about the pin 12 in a direction to raise the hooked end of the locking plate member 10 up and away from the locking pin 20 until it reaches its unlocked position shown in dashed lines in FIG. 1. In similar manner, the hand wheel 64 can be turned in an opposite direction to rotate the locking plate member 10 to its locking position.

As seen in FIG. 1, the pins 52 and 54 of the connecting lever assembly 40 are equidistant from the pin 48 about which these pins 52 and 54 rotate and are spaced apart by 90 degrees relative to the pin 48. Thus, this connecting lever 40 merely translates the approximately vertical movement of the upper shaft member 36 into an equivalent movement of the lower shaft member 38 in an approximately horizontal direction. However, if desired, the length of one of the lever arms of the connecting lever assembly 40 can be different from the other, to give a mechanical advantage. For example, if the pin 54 is spaced further from the pin 48 than the pin 52, less force is required to be exerted on the hand wheel 64 to raise the locking plate member 10.

An electrical interlock 70, actuated by a protruding part 72 of the upper shaft member 36, can be used to indicate the position of the locking plate member 10 and/or to prevent operation of the hydraulic ram to either open or close the barge storage hopper when the locking plate member 10 is in its locking position. Alternately, a mechanical interlock can be used, for example, the motion of any of the moving parts of this device can be used to open or close hydraulic fluid valves for the hydraulic rams.

Also, the outer edge of the locking plate member 10 has a slanted surface 74 which will first contact an upper portion of the lock pin 20 if the barge hopper is closed when the locking plate member 10 is set in its locking position. When this occurs, the slanted surface 74 allows the locking plate member 10 to ride up and over the lock pin 20, then drop back into its locking position about the pin 20. When the locking plate member 10 is rotated upward by the pin 20, the lower shaft member 38 will be moved outward and the upper shaft member 36 will be moved upward, causing the hand wheel 64 to slide upwards in the recessed space of the housing 56, thus giving a visual indication at the top deck of the barge when the locking plate member 10 is secured about the lock pin 20.

The use of the operating shaft assembly 32 shown in FIG. 1 permits the placement of the locking plate member 10 directly beneath the hydraulic ram 46, and the placement of the operating wheel assembly 34 at the side of the hydraulic ram compartment, thus leaving clear the top deck space directly above this compartment which is usually desirable, because of space limitations of the compartment and for easier access to the compartment. However, if space permits, and there is no restriction to placing the operating wheel assembly 34 directly above the hydraulic ram compartment, the locking plate member 10 can be positioned to one side of the hydraulic ram 46 and a single shaft member can be used instead of the operating shaft assembly 32 to connect between the locking plate member 10 and the operating wheel assembly 34.

What is claimed is:

1. A device for mechanically locking together first and second halves of a longitudinally split bottom dump barge when the hopper formed by the two halves is closed wherein both halves are pivotable about a common longitudinal axis which is centrally disposed along the top deck of the barge, and the barge includes means for opening and closing the hopper by pulling together, or pushing apart, the respective bottom portions of the two halves, said device comprising:

a first longitudinally extending pin mounted to a bottom portion of the first half of the dump barge;

a second longitudinally extending pin mounted to a corresponding bottom portion of the second half of the dump barge opposite said first pin;

a locking member, having one end journaled to said first pin for pivotal movement thereabout, and an opposite hook-shaped end which hooks about, and rests upon, said second pin; and positioning and supporting means for said locking member, for pivotally moving the hooked end of said locking member upward to an unlocked position, or downward to a locking position, said positioning and supporting means for said locking member comprises:

a third longitudinally extending pin carried by said locking member;

an operating wheel assembly which includes a housing member pivotably mounted on a top deck of the first half of the dump barge, an operating wheel having an internally threaded hub portion which is supported by and rotatable within said housing member, and an externally threaded shaft extension member which extends through said housing member and is in threaded contact with said operating wheel; and a locking device operating shaft assembly, which has a lower end journaled to said third pin and an upper end connected to said shaft extension member.

2. A device as described in claim 1 which further comprises interlock means for preventing actuation of the barge hopper opening means unless said locking member is in its unlocked position.

3. A device as described in claim 1 which further comprises interlock means for preventing actuation of the barge hopper closing means unless said locking member is in its unlocked position.

4. A device as described in claim 1 wherein the side of said locking member which strikes said second pin when the barge hopper is closed while said locking member is in its locking position is an inclined surface which strikes an upper portion of said second pin, to allow said locking member to ride up and over said second pin, and then drop back into its locking position about said second pin.

5. A device as described in claim 1 wherein said locking device operating shaft assembly comprises:

a fourth longitudinally extending pin mounted to a portion of the first half of the dump barge;

a lever member which is journaled to said fourth pin for pivotal movement thereabout and which carries two additional spaced-apart longitudinally extending pins;

an upper operating shaft member having one end journaled to one of said two additional pins and an opposite end which is said upper end connected to said shaft extension member; and a lower operating shaft member having one end journaled to the other of said two additional pins and an opposite end which is said lower end journaled to said third pin.

6. A device for mechanically locking together first and second halves of a longitudinally split bottom dump barge when the hopper formed by the two halves is closed, wherein both halves are pivotable about a common longitudinal axis which is centrally disposed along the top deck of the barge, and the barge includes means for opening and closing the hopper by pulling together, or pushing apart, the respective bottom portions of the two halves, said device comprising:

a first longitudinally extending pin mounted to a bottom portion of the first half of the dump barge;

a second longitudinally extending pin mounted to a corresponding bottom portion of the second half of the dump barge opposite said first pin;

a locking member, having one end journaled to said first pin for pivotal movement thereabout, and an opposite hook-shaped end which hooks about, and rests upon, said second pin;

positioning and supporting means for said locking member, for pivotally moving the hooked end of said locking member upward to an unlocked position, or downward to a locking position, said positioning and supporting means extending from said locking member to the top deck of the first half of the dump barge; and mounting means on the top deck for mounting the positioning, and supporting means to the top deck, said positioning and supporting means including at the top deck a housing member mounted to said mounting means, and means connected to the locking member for actuating the pivotal movement of the locking member, said means for actuating the pivotal movement of the locking member being supported by said housing member for movement relative thereto, said movement being initiated by the pivotal movement of the locking member when said pivotal movement is in its locking position and in engagement with the second pin.

7. A device as described in claim 6 wherein the side of said locking member which strikes said second pin when the barge hopper is closed while said locking member is in its locking position is an inclined surface which strikes an upper portion of said second pin, to allow said locking member to ride up and over said second pin, and then drop back into its locking position about said second pin.

* * * * *